United States Patent [19]

Nakanishi

[11] Patent Number: 4,971,480

[45] Date of Patent: Nov. 20, 1990

[54] GROUND HARDENING MATERIAL INJECTOR

[75] Inventor: Wataru Nakanishi, Machida, Japan

[73] Assignee: N.I.T. Co., Ltd., Tokyo, Japan

[21] Appl. No.: 380,454

[22] Filed: Jul. 17, 1989

[30] Foreign Application Priority Data

Jan. 10, 1989 [JP] Japan ..... 1-3077

[51] Int. Cl.[5] ..... E02D 3/12

[52] U.S. Cl. ..... 405/269; 405/263; 405/267

[58] Field of Search ..... 405/269, 267, 263, 303, 405/258, 266

[56] References Cited

U.S. PATENT DOCUMENTS 4,624,606 11/1986 Nakanishi et al. ..... 405/269

FOREIGN PATENT DOCUMENTS 0012716 1/1982 Japan ..... 405/269
0027364 6/1983 Japan ..... 405/269
0127825 7/1983 Japan ..... 405/269
0975896 11/1982 U.S.S.R. ..... 405/269

*Primary Examiner*—Taylor Dennis L.
*Attorney, Agent, or Firm*—Shlesinger & Myers

[57] ABSTRACT

A ground hardening material injector comprises a monitor connected to the top of an injection pipe, which monitor includes an upper injection means disposed in the side wall of the monitor and a lower injection means disposed in the opposite side wall of the monitor. The upper injection means further includes an inner injection nozzle for injecting compressed liquid and an outer injection nozzle for injecting compressed gas, and the lower injection means further includes an inner injection nozzle for injecting compressed ground hardening material and an outer injection nozzle for injecting compressed gas.

6 Claims, 6 Drawing Sheets

FIG. 7
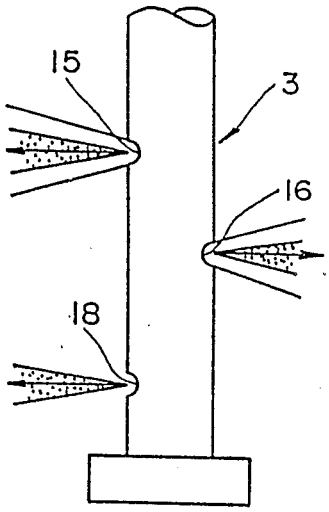
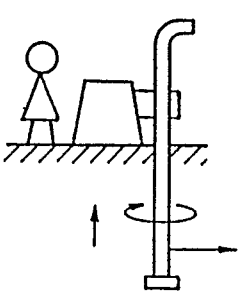
FIG. 8A
(PRIOR ART)
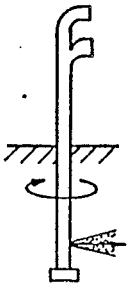
FIG. 8B
(PRIOR ART)
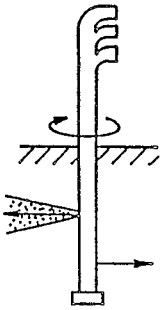
FIG. 8C
(PRIOR ART)

GROUND HARDENING MATERIAL INJECTOR

BACKGROUND OF THE INVENTION

1. Field of the Invention

The present invention generally relates to an injector adapted for injecting ground hardening material in order to improve soft ground and prepare foundation of building site.

2. Description of the Prior Art

Conventionally, various ground hardening material injectors have been provided as shown in FIG. 8. In the drawing, (A) shows the oldest type injector which can inject only ground hardening material; and (B) shows a secondary old type injector which injects ground hardening material with effusing compressed gas such as air. But the type (B) could not overcome some defects, so that in recent years a type (C) injector provided with two injection nozzles has been broadly used. Its upper injection nozzle injects water and gas, and its lower injection nozzle injects only ground hardening material. In detail, the upper injection nozzle can inject the compressed water to a great distance by effusing gas around the water so that the compressed water can forcibly discharge liquid sludge towards the ground surface. This liquid sludge discharging effect has been known as "air lift effect". On the other hand, the lower injection nozzle does not inject gas and thus such air lift effect owing to cavitation by effusing gas can not be generated. Accordingly, the ground hardening material injected from the lower injection nozzle will be substituted for only the liquid sludge removed by the air lift effect by the upper injection nozzle. This means that the ground hardening material will not reach to required far distance and may flow upwardly to ground surface. This type (C) has provide poor displacement ratio; ½ or less, from ground to the ground hardening material.

BRIEF SUMMARY OF INVENTION

It is therefore the primary object of the present invention to provide a ground hardening material injector which can overcome the above described problems.

It is another object of the present invention to provide a ground hardening material injector which can extend the injection range of the ground hardening material to displace sludge at a high efficiency.

It is a further object of the present invention to provide a ground hardening material injector which can effectively adjust the pressure of compressed gas injected from the injector.

To accomplish the above objects, the ground hardening material injector according to the present invention comprises a monitor connected to the top of an injection pipe, an upper injection means disposed in the side wall of the monitor including an inner injection nozzle for injecting compressed liquid and an outer injection nozzle for injecting compressed gas, and a lower injection means disposed in the side wall of the monitor including an inner injection nozzle for injecting compressed ground hardening material and an outer injection nozzle for injecting compressed gas. The ground hardening material injector further comprises a pressure adjusting means to control the injection pressure of compressed gas between the upper injection means and the lower injection means.

According to the present invention, compressed liquid such as water injected from the inner injection nozzle of the, upper injection means is enveloped by compressed gas injected from the outer injection nozzle of the upper injection means, and compressed ground hardening material injected from the inner injection nozzle of the lower injection means is also enveloped by compressed gas injected from the outer injection nozzle of the lower injection means. Sludge in the ground is broken and displaced out of the ground surface by the compressed water with compressed gas injected from the upper injection means and then the ground hardening material with compressed gas injected from the lower injection means can spread into the substantially cylindrical space caused by displacing the sludge. The ground hardening material can broadly and effectively penetrate into even narrow space far from the injector owing to the compressed gas enveloping the hardening material. The pressure of the compressed gas injected from the upper and lower injection means are adjusted so as to achieve the sludge removing operation and the ground hardening operation.

Other and further objects of this invention will become obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWING

FIG. 7 is a schematic illustration showing an injection state of a second embodiment of the ground hardening material injector; and FIG. 8 (A–C) are schematic illustrations showing conventional injectors aligned in historical order.

DETAILED DESCRIPTION OF THE PREFERRED EMBODIMENT

A preferred embodiment of the present invention will be explained in conjunction with the accompanying drawings.

Figure 1:
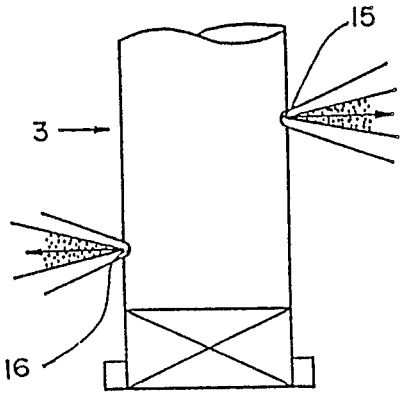
FIG. 1 is a schematic illustration showing one example of injecting state of a first embodiment of the ground hardening material injector according to the present invention.
Figure 6:
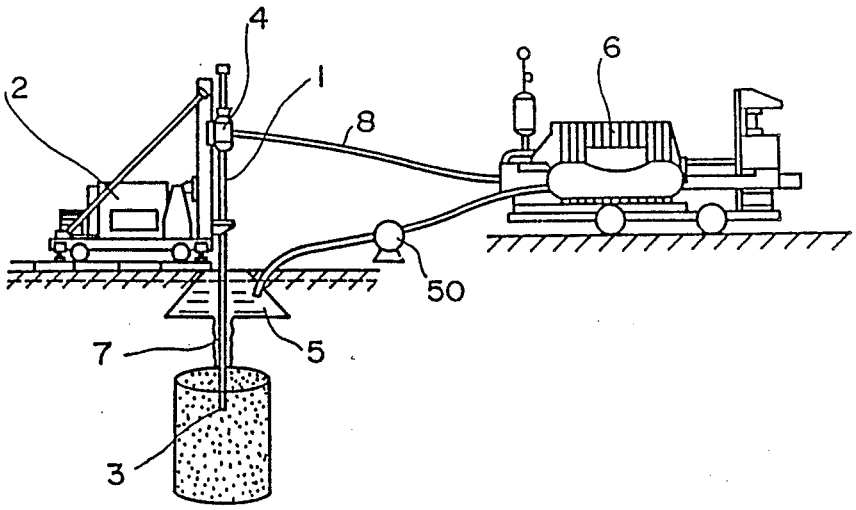
FIG. 6 is a schematic illustration showing one example of working state of the ground hardening material injector associated with assistant devices.

FIG. 1 shows a general view of a first embodiment of a ground hardening material injector, wherein the reference numeral 3 denotes a monitor including an upper injection means 15 and a lower injection means 16. The upper injection means 15 is designed so as to inject super high pressure water through an inner nozzle and super high pressure gas through an outer nozzle coaxially surrounding the inner nozzle. Also the lower injection means 16 is designed so as to inject super high pressure ground hardening material through an inner nozzle and super high pressure gas through an outer nozzle coaxially surrounding the inner nozzle. The monitor 3 is connected to a swivel joint 4 through an injection pipe 1, as shown in FIG. 6.

Figure 2:
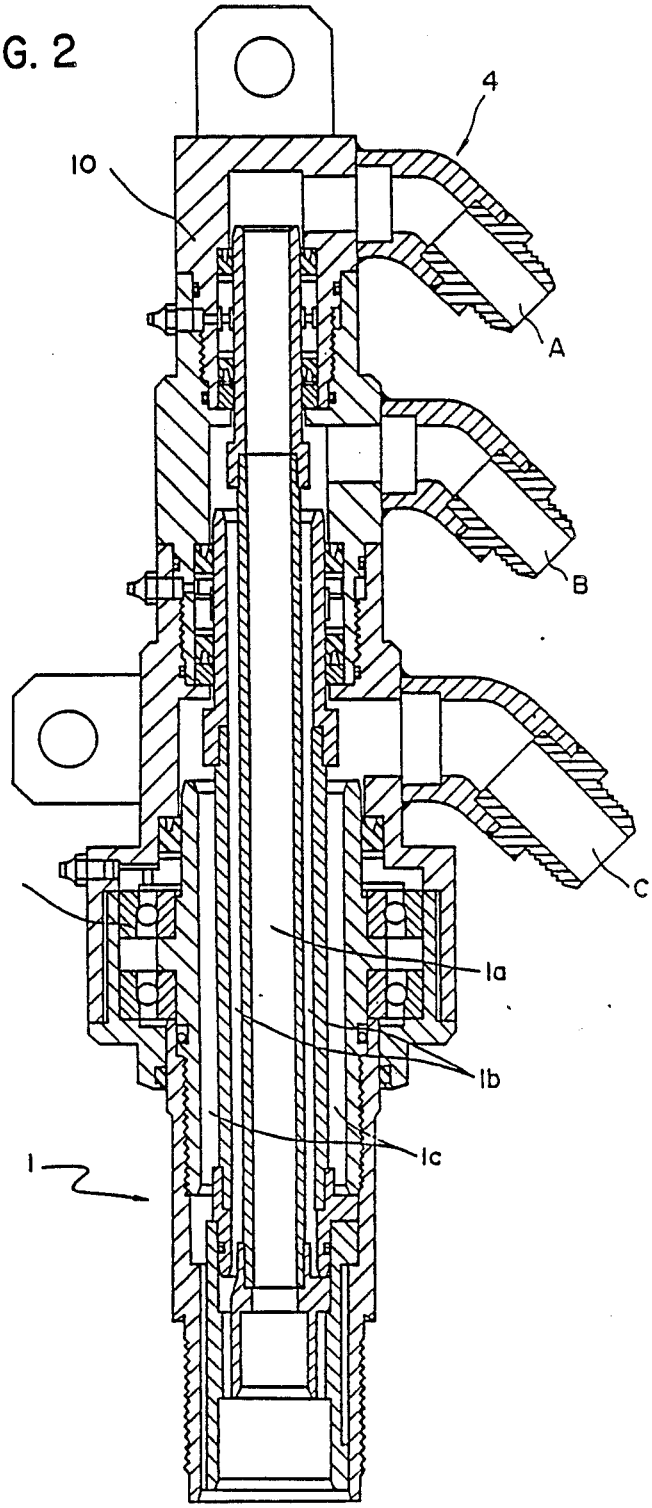
FIG. 2 is a vertical cross sectional view showing the swivel joint connected to the ground hardening material injector according to the present invention.

FIG. 2 shows one example of triple tube swivel joint 4 adapted for the present invention. The triple tube swivel joint 4 includes a stationary swivel body 10 to which the injection pipe 1 is pivotably connected through a bearing 11. The stationary swivel body 10 includes a first intake joint A, a second intake joint B and a third intake joint C. The injection pipe 1 includes an external pipe member 13*a*, an intermediate pipe member 13*b* and a core pipe member 13*c* which are coaxially arranged. The core pipe member 13*c* defines a first conduit 1*a* for high pressure ground hardening material, the core pipe member 13*c* and the intermediate pipe member 13*b* define a second conduit 1*b* for high pressure water, and the intermediate pipe member 13*b* and the external pipe member 13*a* define a third conduit 1*c* for high pressure gas. The first conduit 1*a*, the second conduit 1*b* and the third conduit 1*c* are respectively communicated with the first intake joint A, the second intake joint B and the third intake joint C.

Figure 3:
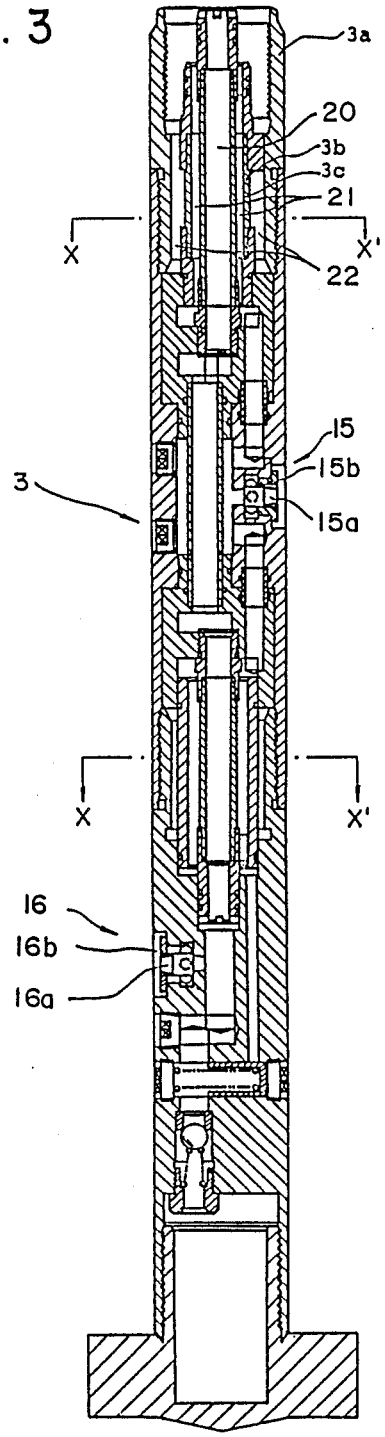
FIG. 3 is a vertical cross sectional view showing the monitor of a first embodiment of the ground hardening material injector according to the present invention.

FIG. 3 shows the structure of the monitor 3 which includes an external pipe member 3*a*, an intermediate pipe member 3*b* and a core pipe member 3*c* which are coaxially arranged. The core pipe member 3*c* defines a first conduit 20 for high pressure ground hardening material, the core pipe member 3*c* and the intermediate pipe member 3*b* define a second conduit 21 for high pressure water, and the intermediate pipe member 3*b* and the external pipe member 3*a* define a third conduit 22 for high pressure gas. The first conduit 20, the second conduit 21 and the third conduit 22 are respectively communicated with the first intake joint A, the second intake joint B and the third intake joint C through the first conduit 1*a*, the second conduit 1*b* and the third conduit 1*c* of the injection pipe 1.

Figure 5:
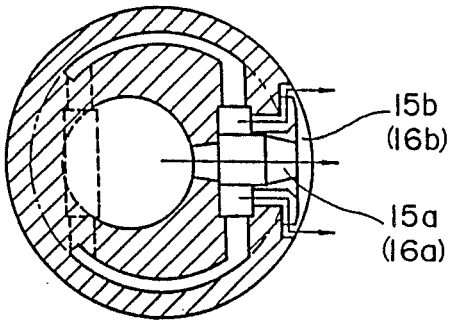
FIG. 5 is a cross sectional view taken along the line X—X' of FIG. 3, showing the monitor of the injector according to the present invention.

The monitor 3 further includes the upper injection means 15 and the lower injection means 16 which are arranged in the opposite side wall of the monitor 3. The upper injection means 15 includes an inner injection nozzle 15*a* communicated with the second conduit 21 and an outer injection nozzle 15*b* communicated with the third conduit 22. Also the lower injection means 16 includes an inner injection nozzle 16*a* communicated with the first conduit 20 and an outer injection nozzle 16*b* communicated with the third conduit 22. FIG. 5 shows a cross sectional view of the upper injection means 15 (the lower injection means 16).

The upper injection means 15 and the lower injection means 16 are oppositely arranged because the injection force will symmetrically apply during working state.

The pressure of the compressed gas injected from the upper injection means 15 and the lower injection means 16 can be independently adjusted by varying the nozzle diameter thereof. Generally, the pressure depends on working condition such as hardness of the ground to be treated, kind of the ground hardening material, injection rate of the hardening material, and so on.

FIG. 6 shows an example of working state of the above constituted ground hardening material injector. The monitor 3, the injection pipe 1 and the swivel joint 4 are vertically connected and supported by a drive apparatus 2. The three intake joints A, B and C of the swivel joint 4 are respectively connected to feed pipes 8 through which high pressure ground hardening material, high pressure water and high pressure gas are fed from a compressor unit 6 into the first conduit 1*a*, the second conduit 1*b* and the third conduit 1*c* respectively.

An operation of the ground hardening material injector according to the present invention will be described.

The monitor 3 of the injector is inserted into a guide hole 7 formed in the ground to be treated by the drive apparatus. As the monitor 3 reaches to the bottom of the guide hole 7, the high pressure ground hardening material, high pressure water and high pressure gas are fed from the compressor unit 6 into the first conduit 20, the second conduit 21 and the third conduit 22 of the monitor 3 through the intake joints A, B and C of the swivel joint 4 and the first, second and third conduits 1*a*, 1*b* and 1*c* of the injection pipe 1, respectively. Then the monitor 3 is revolved and lifted upwardly by the drive apparatus 2. The upper injection means 15 injects super high pressure water enveloped with high pressure gas such as air to break the surrounding sludge and remove it to a sludge pool. The high pressure gas makes the water and the sludge to be lifted upwardly owing to its lifting effect, so that artificial space is generated around the monitor 3. Then the ground hardening material injected at a super pressure from the lower injection means 16 is easily and broadly spread to achieve ground hardening treatment.

Conventionally, the lifted sludge and water have been pressed by a packer to return into the ground or remained on the ground surface without any treatment. This causes the sludge density in the ground be higher and makes the injection efficiency of the ground hardening material be poor. In order to overcome this defect, the lifted sludge and water stored in a sludge pool 5 is positively sucked by a pump 50 as shown in FIG. 6, so that the ground hardening material will be injected more effectively and thus filling density of the ground hardening material will be increased. This ground hardening system can form a cylindrical ground hardened layer at a remarkably short time.

Figure 4:
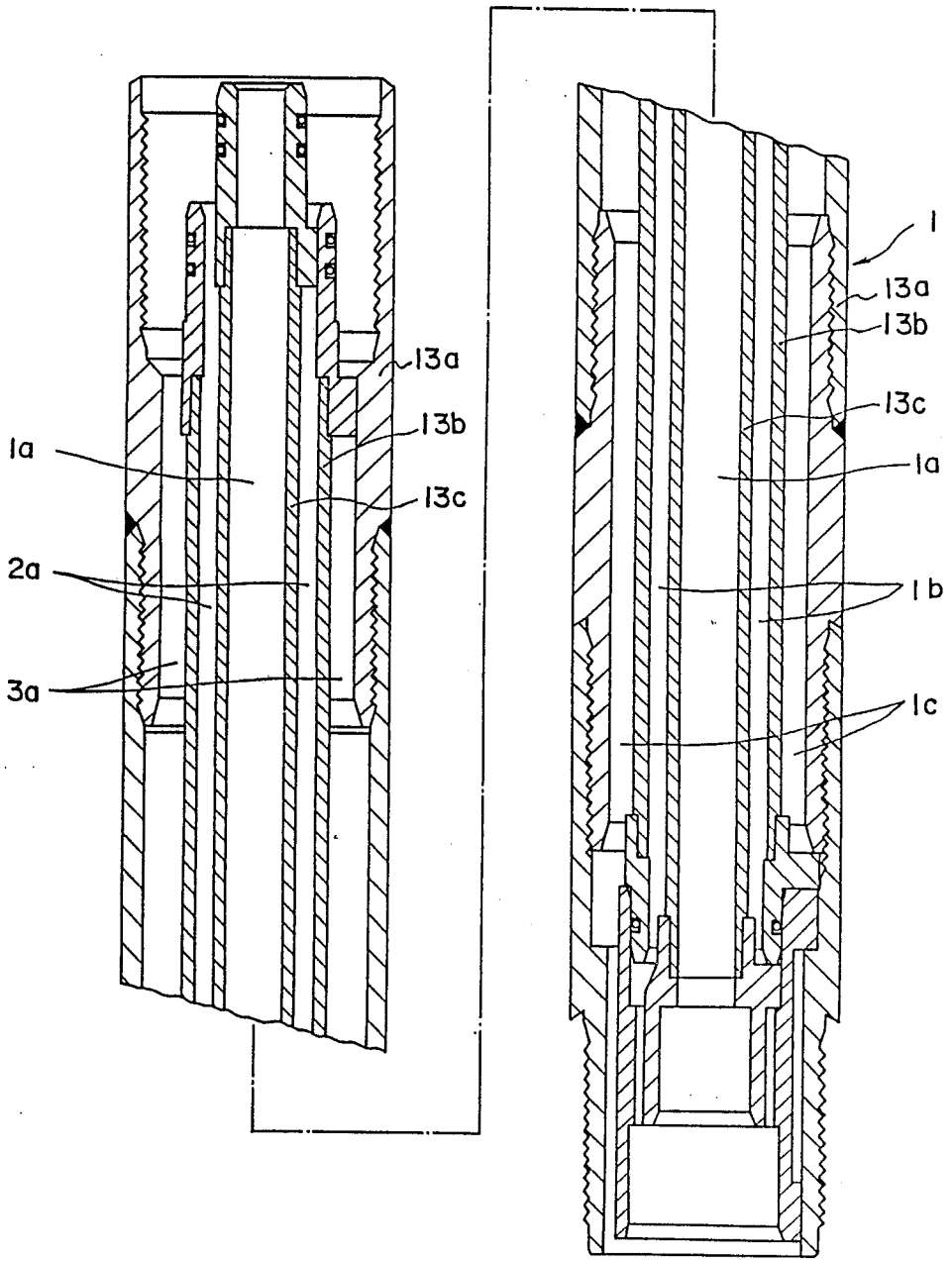
FIG. 4 is a vertical cross sectional view showing the injection pipe of the ground hardening material injector shown in FIG. 1.

Since the injection pipe 1 can be threadingly engaged with an extension pipe as shown in FIG. 4, the total length of the injection pipe 1 can be freely varied in response to the working depth. Further the injection pipe 1 is not limited to a circular cross sectional shape, but any polygonal shape such as pentagonal or octagonal shape may be used in response to working condition.

FIG. 7 shows a second embodiment wherein a monitor 3 includes an auxiliary injection means 18 in addition to an upper injection means 15 and a lower injection means 16. This auxiliary injection means 18 is designed so as to inject only the super high pressure ground hardening material for increasing injection efficiency of the ground hardening material or supplementing the ground hardening material. It is needless to explain that the ground hardening material injector according to the present invention may include a pluarity of auxiliary injection means.

As given explanation above, the injector according to the present invention provides following effects.

Since the lower injection means also injects compressed gas, preferably super high pressure gas, cooperative injection effect between the upper and lower injection means can be expected. This means that the compressed gas injected from the lower injection means also makes the ground hardening material to be spread and extended with wide range in addition to the lifting effect caused by the compressed gas and high pressure water injected from the upper injection means. Further the pressure of the compressed gas injected from the upper injection means 15 and the lower injection means 16 can be independently adjusted by varying the nozzle diameter thereof so that the filling density of the ground hardening material, working efficiency and working period can be improved.

It is further understood by those skilled in the art that the foregoing description is a preferred embodiment of the disclosed device and that various changes and modifications may be made in the invention without departing from the spirit and scope thereof.

What is claimed is:

1. A ground hardening material injector, comprising:

(a) an injection pipe communicating with a compressor unit through a swivel joint;

(b) said injection pipe including an external pipe member, an intermediate pipe member and a core pipe member for defining a first conduit through said core pipe member for compressed ground hardening material, a second conduit between said core pipe member and said intermediate pipe member for compressed liquid, and a third conduit between said intermediate pipe member and said external pipe member for compressed gas;

(c) a monitor being connected to a lower end of said injection pipe;

(d) said monitor including an upper injection means disposed in one sidewall of said monitor;

(e) said upper injection means further comprising an inner injection nozzle communicating with said second conduit of said injection pipe and an outer injection nozzle communicating with said third conduit of said injection pipe;

(f) a lower injection means being disposed in the other sidewall of said monitor; and (g) said lower injection means further including an inner injection nozzle communicating with said first conduit of said injection pipe and an outer injection nozzle communicating with said third conduit of said injection pipe.

2. The ground hardening material injector as in claim 1, wherein:

(a) said monitor comprises an external pipe member, an intermediate pipe member and a core pipe member for defining a first conduit through said core pipe member, a second conduit between said core pipe member and said intermediate pipe member, and a third conduit between said intermediate pipe member and said external pipe member; and (b) said monitor first, second and third conduits communicating respectively with said first conduit of said injection pipe and said inner nozzle of said lower injection means, said second conduit of said injection pipe and said inner nozzle of said upper injection means, and said third conduit of said injection pipe and both of said outer nozzles of said upper and lower injection means.

3. The ground hardening material injector as in claim 1, wherein:

(a) said monitor further comprises a pressure adjusting means for varying the injection pressure of the compressed gas through said upper injection means and said lower injection means.

4. The ground hardening material injector as in claim 3, wherein (a) said pressure adjusting means includes means for varying the diameter of said injection nozzles of said upper and lower injection means.

5. The ground hardening material injector as in claim 1, wherein:

(a) said monitor further comprises at least one auxiliary injection nozzle disposed below said upper and lower injection means.

6. The ground hardening material injector as in claim 5, wherein:

(a) said auxiliary injection nozzle is adapted to inject compressed ground hardening material.

* * * * *